US007854585B2

(12) United States Patent
Petitjean

(10) Patent No.: US 7,854,585 B2
(45) Date of Patent: Dec. 21, 2010

(54) VARIABLE GEOMETRY COMPRESSOR

(75) Inventor: Dominique Petitjean, Julienrupt (FR)

(73) Assignee: Honeywell International Inc., Morristown, NJ (US)

( * ) Notice: Subject to any disclaimer, the term of this patent is extended or adjusted under 35 U.S.C. 154(b) by 835 days.

(21) Appl. No.: 11/792,540

(22) PCT Filed: Nov. 8, 2004

(86) PCT No.: PCT/EP2004/014919

§ 371 (c)(1),
(2), (4) Date: Jun. 6, 2007

(87) PCT Pub. No.: WO2006/048042

PCT Pub. Date: May 11, 2006

(65) Prior Publication Data

US 2008/0118349 A1 May 22, 2008

(51) Int. Cl.
*F04D 29/46* (2006.01)

(52) U.S. Cl. ..... 415/150; 415/159; 415/160; 415/163; 415/164

(58) Field of Classification Search ..... 415/150, 415/159, 160, 163, 164
See application file for complete search history.

(56) References Cited

U.S. PATENT DOCUMENTS

| | | | | |
|---|---|---|---|---|
| 3,495,921 | A * | 2/1970 | Swearingen | 415/163 |
| 3,799,694 | A | 3/1974 | Duzan | |
| 3,992,128 | A * | 11/1976 | Lunsford et al. | 415/161 |
| 4,338,063 | A | 7/1982 | Nakanishi | |
| 4,657,476 | A * | 4/1987 | Berg | 415/48 |
| 5,146,752 | A * | 9/1992 | Bruestle | 415/164 |
| 6,506,011 | B1 | 1/2003 | Sishtla | |
| 2002/0176774 | A1 | 11/2002 | Zinsmeyer et al. | |

OTHER PUBLICATIONS

PCT ISR/WO Honeywell.

* cited by examiner

*Primary Examiner*—Igor Kershteyn
(74) *Attorney, Agent, or Firm*—Brian Pangrle

(57) ABSTRACT

A variable geometry compressor for use in, for example, a turbocharger. A swing-vane diffuser is provided down-stream of the centrifugal compressor wheel. A nozzle ring is adjustable mounted on a center housing, and defines the nozzle face for the compressor diffuser. No spacers are deployed in the diffuser thereby improving efficiency, yet by stacking only the vanes and the nozzle ring, the diffuser clearances are maintained within strict tolerances. Further, seals, such as O-rings, are situated between the nozzle ring and the compressor housing and back plate to eliminate deleterious gas leaks between the diffuser and the spaces behind the nozzle ring.

18 Claims, 4 Drawing Sheets

VARIABLE GEOMETRY COMPRESSOR

BACKGROUND OF THE INVENTION

1. Field of the Invention (Technical Field)

The present invention relates to compressors, particularly gas compressors, and specifically to a compressor with a geometry variable to adapt the compressor diffuser flow area to differing air mass flow rates.

2. Background Art

A conventional compressor apparatus, for example a turbocharger for use in association with internal combustion engines, includes an exhaust gas driven turbine and an inlet air compressor. The inlet air compressor is driven by power generated by the exhaust gas driven turbine wherein a turbine wheel of the exhaust gas driven turbine is mounted on a common shaft with a compressor impeller of the inlet air compressor.

The conventional compressor apparatus is provided with a housing having an exhaust gas inlet for supplying the exhaust gas to the exhaust gas turbine.

It is known in the art to provide a nozzle in a passage for urging a fluid, e.g. compressed air, toward the inlet of the engine, provides a variable geometry with the vanes in the nozzle being rotatably mounted to provide a variable geometry.

It is the object of the present invention to supply a variable flow nozzle downstream of the centrifugal compressor wheel in a compressor, to provide with a compressor with an improved configuration and an enhanced efficiency.

SUMMARY OF THE INVENTION (DISCLOSURE OF THE INVENTION)

A variable geometry compressor for use in, for example, a turbocharger. A swing-vane diffuser is provided downstream of the centrifugal compressor wheel. By using optimum vane profiles and controllably pivoting the diffuser vanes at different angles, the cross-sectional diffuser flow area can be regulated at varying values to suit different air mass flow rates, and the flow incidence at diffuser vane leading edges is minimized. A nozzle ring is adjustable mounted in the compressor housing, and defines the nozzle face for the compressor diffuser. No spacers are deployed in the diffuser thereby improving efficiency, yet by stacking only the vanes and the nozzle ring, the diffuser clearances are maintained within strict tolerances. Further, seals, such as o-rings, are situated between the nozzle ring and the compressor housing and back plate to eliminate deleterious gas leaks between the diffuser and the spaces behind the nozzle ring.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 2:
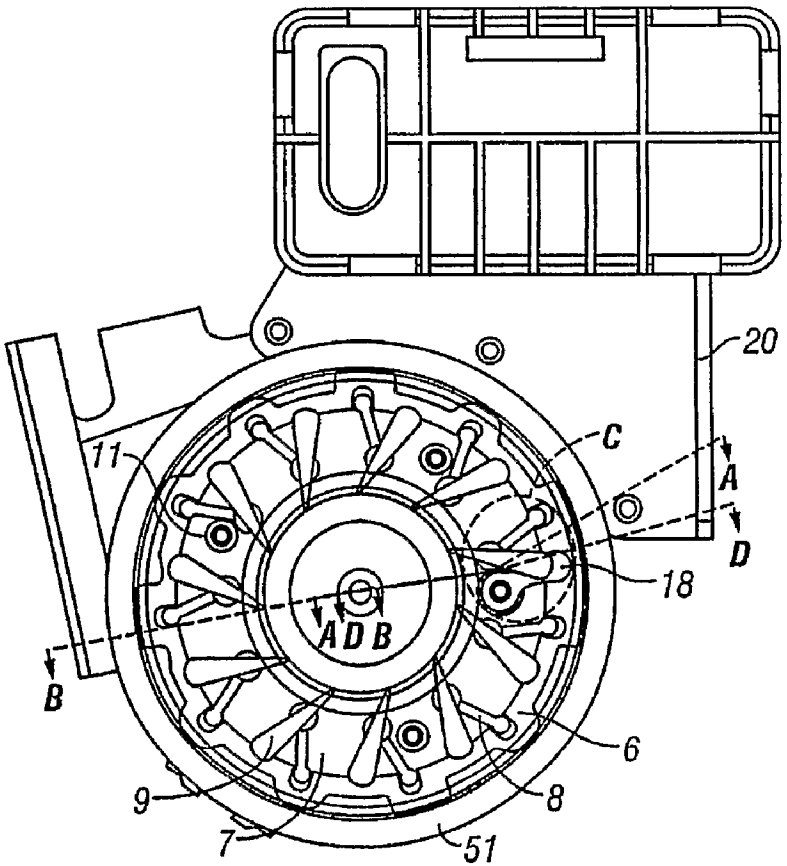
FIG. 2 a portion of the turbine apparatus seen in FIG. 1, with the turbine side removed to provide a "transparent" axial view of the inventive compressor side, showing the array of diffuser vanes according to the invention, and the unison ring and vane arms for controllably pivoting the diffuser vanes.

DESCRIPTION OF THE PREFERRED EMBODIMENTS (BEST MODES FOR CARRYING OUT THE INVENTION)

Reference is invited to the drawing figures, showing a preferred embodiment of the present invention.

First, an apparatus according to the present invention, which may be a turbocharger, is explained generally. Referring to the figures, the apparatus is provided with a housing which houses an exhaust gas turbine 35 and an inlet air compressor 30.

The inlet air compressor 30 includes an inlet air compressor wheel or impeller 4. The inlet air compressor impeller 4 is mounted on a shaft which is rotatably supported in a center housing 2 generally according to convention.

Figure 1:
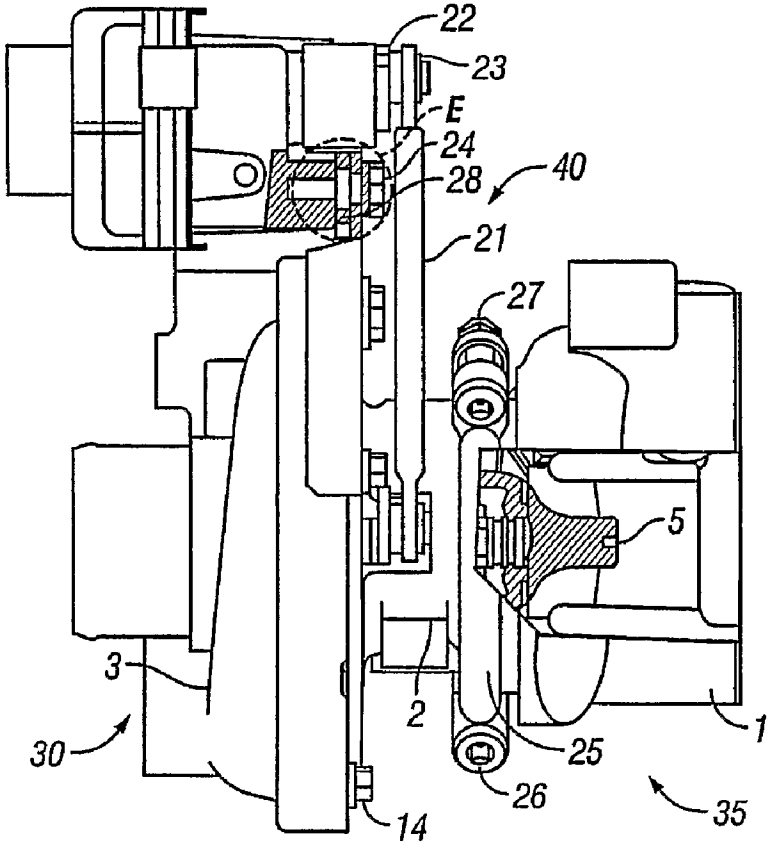
FIG. 1 is a side view of a turbine apparatus according to the present invention, with a portion cut away to reveal the turbine wheel and shaft, providing context for the invention.

The exhaust gas turbine 35 includes an exhaust gas turbine wheel 5 which is mounted on the same shaft as the inlet air compressor wheel 4. Turbine housing 1 defines a turbine flow volute around the turbine wheel 5, all as best seen in FIG. 1.

Figure 4:
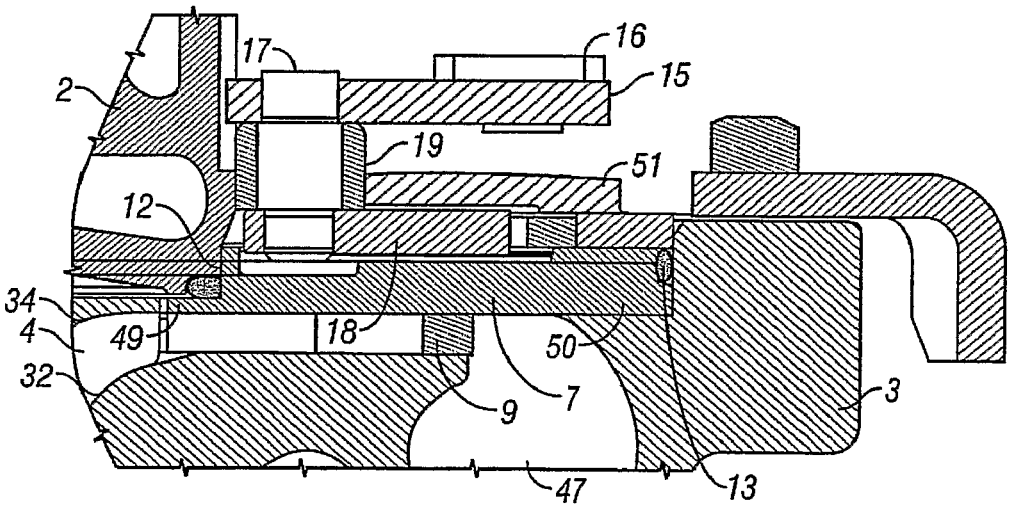
FIG. 4 is another enlarged sectional view of a different portion of the apparatus seen in FIGS. 1 and 2, taken along section line B-B in FIG. 2.
Figure 5:
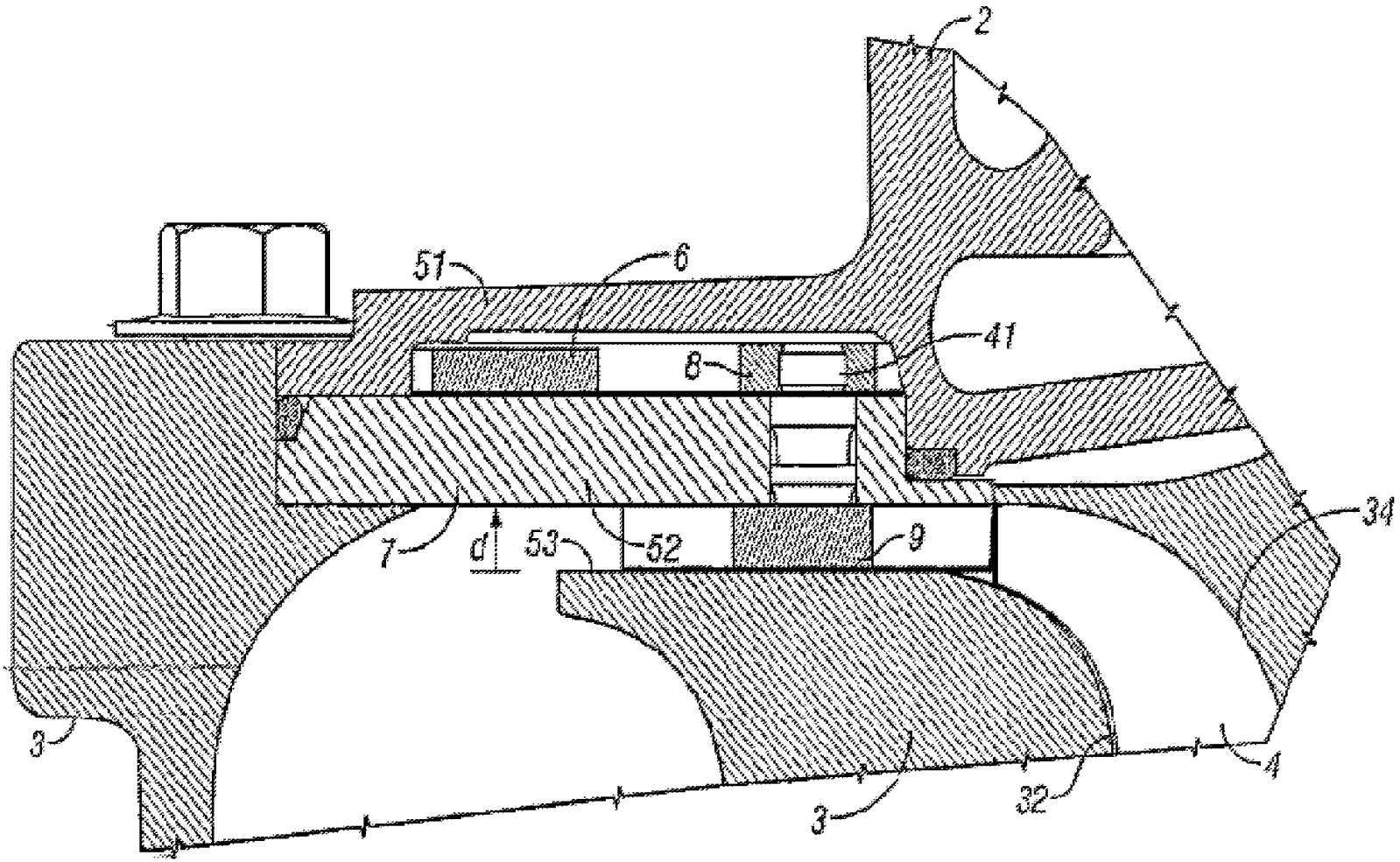
FIG. 5 is an axial view of a portion of the apparatus depicted in FIG. 2, enlarged to show the linkage of the vane arms to the unison ring.
Figure 6:
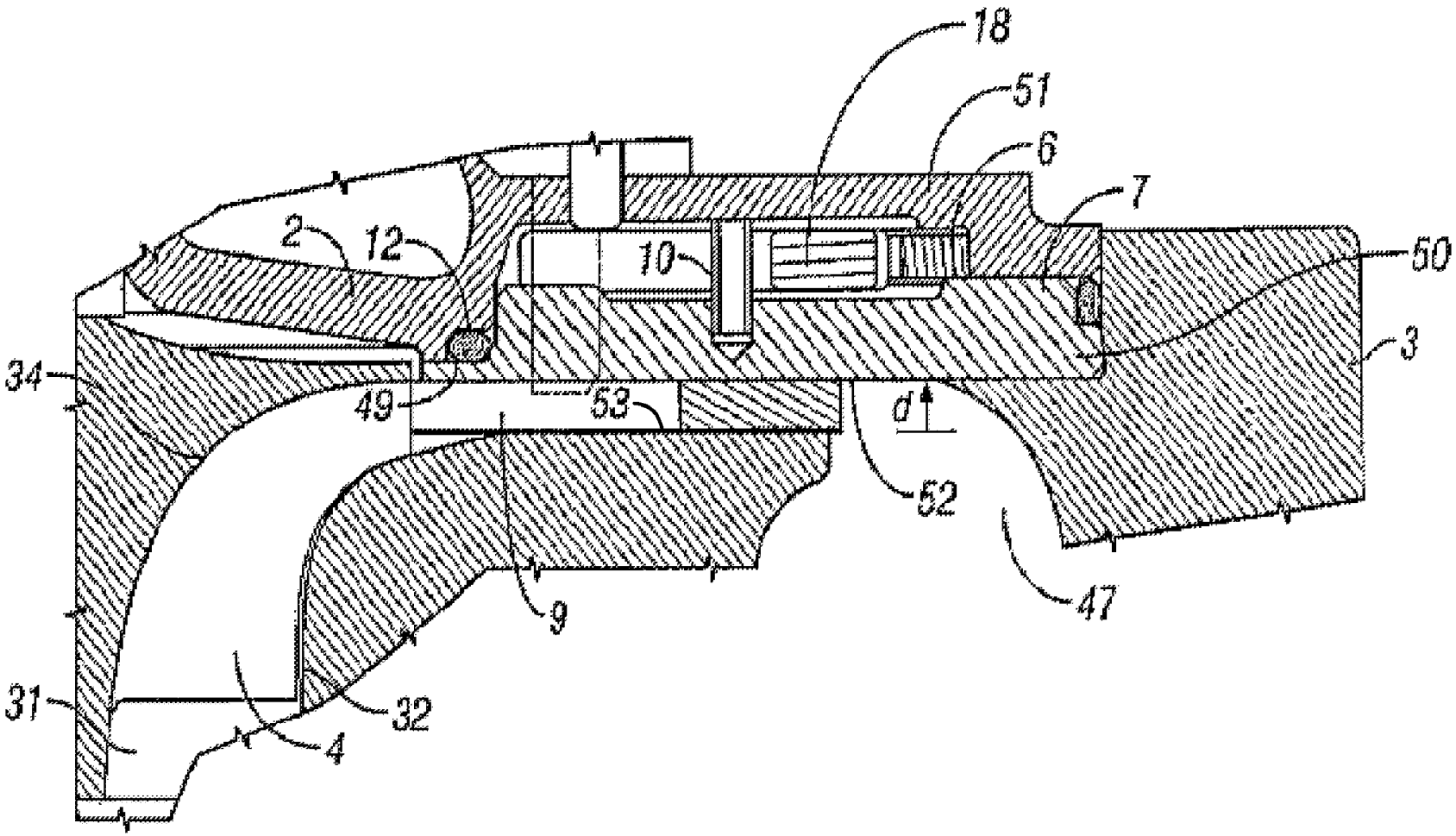
FIG. 6 is yet another enlarged sectional view of still a different portion of the apparatus seen in FIGS. 1 and 2, taken along section line D-D in FIG. 2.

As shown in FIGS. 4-6, a passage surrounding the compressor wheel 4 is formed by an inner wall 34 and an outer wall 32. At the end of the passage, a variable compressor nozzle is provided which comprises an annular arrangement of vanes 9 situated in the diffuser of the compressor. The embodiment depicted in the drawing figures features eleven vanes 9, but this is by way of illustration rather than limitation; any suitable number of vanes may be provided to optimize aerodynamics.

Each vane 9 is supported on a shaft 41 (FIG. 5) which forms a rotational axis for that vane. The shaft 41 is fixedly joined to and extends from the vane 9. The longitudinal direction of a vane's rotational axis extends between a face 53 (e.g. a substantially planar diffuser surface) of the housing 3 and an annular nozzle ring 7 (FIGS. 5 and 6). Thus, the vanes 9 are pivotable about their respective rotational axes, the shafts 41 pivoting with their respective vanes, and the axes of rotation being generally parallel to the axis of rotation of the compressor wheel 4.

As best shown in FIG. 2, the vanes 9 preferably are formed in an elongated teardrop or wedge shape. Description of any single vane 9 describes the other vanes. The tips of the vanes 9 are directed upstream, against the gas flow in the compressor passage defined between the walls 32, 34. The broader, rounded butt of each vane 9 is downstream, and proximate to the vane's supporting shaft 41. However, the shape and contour of the respective vanes is not critical to this invention, and it should be understood that the vanes may have other suitable shapes.

Figure 3:
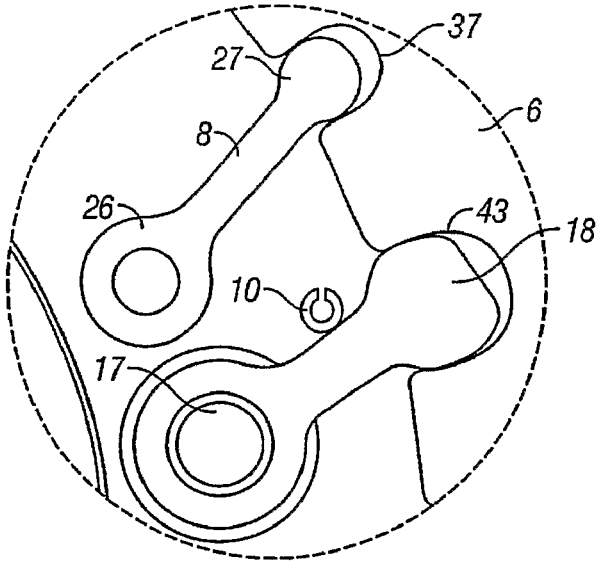
FIG. 3 is an enlarged sectional view of a portion of the apparatus of the invention seen in FIGS. 1 and 2, taken along section line A-A in FIG. 2.

Each vane 9 is connected by the shaft 41 to a vane arm 8 (FIGS. 2, 3, 5). Description of any vane arm 8 effectively describes them all. The connection of the shaft 41 to the vane arm 8 is fixed, as by welding, so that a vane 9, its shaft 41, and the associated vane arm 8 rotate together as a unit. As best seen in FIG. 3, each vane arm 8 has an enlarged inner end 26 defining an eye for receiving the shaft 41 whereby the arm 8 is connected to a medial portion of the vane 9 (as shown in FIG. 5). A shaft connects the inner end 26 of the vane arm 8 to its round outer end knob 27. As seen in FIGS. 2 and 3, the vane arm outer end knob 27 is rotatably disposed within a corresponding socket 37 defined in the inner face of the annular unison ring 6. Each ring socket 37 preferably is generally circular, with a diameter modestly greater than the diameter of the arm end knob 27, so that the knob 27 rotates freely in the socket 37 with little lateral play; socket 37 encloses the knob 27, so that knob 27 cannot be pulled radially from the socket.

A nozzle ring 7 is mounted in the housing 3, between the housing and the back plate 51. Back plate 51 extends radially out from the center housing 2, and may be integrally molded or machined therewith, or welded thereon, or alternatively may be a separate component bolted or otherwise removably attached to the center housing. Thus, the back plate 51 may be a distinct detachable element. For each vane 9 a separate shaft 41 is provided such that an annular array of shafts is formed. The shafts 41 pass through corresponding holes in the nozzle ring 7, and are rotatable in the holes. Nozzle ring 7 provides the innermost extent of the flow passage, and also defines the nozzle 52 face adjacent to which the vanes 9 pivot, as indicated in FIGS. 4-6.

Continuing the reference to FIGS. 4-6, it is seen that a unison ring 6 is rotatably held on the compressor housing back plate 51 coaxial with and in parallel flush sliding contact with the nozzle ring 7. The unison ring 6 is rotatable about an axis which is aligned with the axis of the common shaft of the wheels 4, 5.

Rotation of the unison ring 6, with the vane arms 8 pivotally attached thereto by their movable engagement in the sockets 37, permits the rotational position of the vanes 9 to be adjustable. The sockets 37 are concavities, but need not have any particular sectional shape; circular sockets suitably receive a knob 27. By adjusting the rotational position of the vanes 9, the fluid passage area, in the diffuser space of the compressor nozzle, can be regulated. That is, the passage area is decreased by moving the vanes 9 in a direction for aligning the vanes with the tangential direction with respect to the compressor impeller or wheel 4, whereas the passage area is increased by moving the vanes 9 to a direction for aligning the vanes with the radial direction of the compressor wheel 4. By a movement of the vanes 9, the component of velocity of the flow between the vanes in the radial and the tangential direction can be adjusted to optimize performance.

The unison ring 6 is operable by a crank mechanism 40 operably connected to the unison ring. The more fundamental elements of the invention are useable with any crank mechanisms known in the art. A preferred embodiment includes the innovative crank mechanism seen best in FIGS. 1-3. The inventive crank mechanism includes the crank control 22 connected to a crank arm 21 by means of a retaining ring connection 23 as seen in FIG. 1. Referring to FIGS. 1 and 4, it is seen that in the crank mechanism 40 the crank arm 21 is pivotally connected to a crank linkage 15 by means of an external crank pin 16. An internal crank pin 17 connects the crank linkage 15 to an internal arm 18. The crank mechanism further includes an internal crank pin 17 rotatably mounted, as by bushing 19, in a mounting aperture in the compressor housing back plate 51 as seen in FIG. 4. The internal arm 18, in turn, drives the movement of the unison ring 6. Again, however, the particular crank mechanism or means is not critical to the invention.

Diffuser clearance is improved in the invention without the use of spacers commonly employed in variable geometry compressors known in the art. Combined reference is made to FIGS. 4-6. As previously explained as known in the art, the compressor wheel 4 rotates within the housing inflow section 31 within the compressor housing 3. The gas is accelerated as it flows in the passage defined between outer and inner walls 34, 32, the walls 32, 34 converging in the direction of the vanes 9. The vanes 9 are disposed in the diffuser space between the nozzle ring 7 and the housing 3 downstream from the compressor wheel 4, at the inside termini of the converging walls 32, 34.

As best seen in FIGS. 5 and 6, it is seen that the vanes 9 are disposed in the diffuser defined between the annular nozzle ring 7 and an annular diffuser surface 53 of the housing 3. The need to provide spacers across the diffuser is eliminated. The nozzle ring 7 is situated in an annular ring defined in the nozzle portion of the housing, on the opposite side of the vanes 9 from the diffuser surface 53. The diffuser surface 53 preferably is substantially planar. However, it will be immediately appreciated by those of ordinary skill in the art that the diffuser surface 53 need not be defined by a single plane throughout its extent. Rather, the surface may be modified to adapt the diffuser to address certain conditions. For example, the surface 53 may have a slight step or chamfer where the leading edges of the vanes 9 pivot (downstream of the wheel 4 and generally upstream of the vanes). Such a modestly modified surface 53 might be desirable, for instance, to improve durability in environments where detrimental deposits pose potential problems. Or, a slightly stepped or conically machined surface 53 may serve the purpose of reducing even further the nominal vane end clearance when the vanes are closed or up to about ⅓ open, when small clearance is of paramount importance, and yet providing more clearance between ⅓ open and full open vane condition.

The nozzle ring 7 and the diffuser surface 53 are substantially parallel and are separated by clearance dimension as depicted in FIGS. 5 and 6. The outer surface or side of the nozzle ring 7 defines the nozzle face 52 in adjacency with the vanes 9. The nozzle face 52 and the housing diffuser surface 53 are separated generally uniformly by a diffuser clearance distance d as depicted in FIGS. 5 and 6. The diffuser clearance distance d is very slightly greater than the axial height or height of the vanes 9.

It is seen thus that in the inventive variable geometry compressor, the compressor housing 3 has the annular, preferably substantially planar, surface 53 therein, while the nozzle ring 7 is seated on the housing. The nozzle ring 7 defines the annular nozzle face 52 in spaced-apart relation from the face or surface 53, as the diffuser space is defined between the nozzle face and the diffuser surface. In this assembly, the one or more pivotal diffuser vanes 9 in the diffuser space are as proximate to the nozzle face 52 as to pivot slidably against it. As seen in the Figures, the nozzle face 52 and the diffuser surface 53 are substantially parallel and spaced-apart by the diffuser clearance distance. The diffuser clearance distance d is adjustable by modifying the position of the nozzle ring in relation to the diffuser surface.

Notably, the invention is not limited to the components orientation depicted in the drawing figures. The apparatus can be configured, in an alternative embodiment, in a reversed or "mirror image" configuration. Thus, an alternative embodiment of the claimed invention may feature an "inverted" layout, to be semi-symmetrical to the version depicted in the drawings, relative to a radial plane through the diffuser. Such a reversed embodiment could, for example, place the nozzle ring where the present drawing figures show the diffuser face located, place the unison ring, vane arms, etc. around the compressor inlet, and have the opposite face simply flat machined in the center housing back plate. Thus, it is intended to cover in the appended claims any alternative embodiments of the invention which employ any such a "flipped" or reversed design, where the alternative embodiment is reflected in a radial plane.

An advance of the invention is the minimization of the diffuser clearance without spacers. Spacers, commonly used in the art, ordinarily are within the diffuser region of the compressor, and thus cause aerodynamic losses, and may generate controllability problems. In contrast, in the present invention the vanes 9 pivot against the nozzle face 52 on the nozzle ring 7 (the nozzle ring being removably seated on the compressor housing). Advantageously, the diffuser clearance (i.e. difference between the height of a vane 9 and the diffuser clearance distance d) is controlled and determined by a single, and only one, compressor dimension—the clearance distance d. Meticulous machining of the vanes 9 permits the vane height to be fixed, while the axial position of the nozzle ring 7 (and thus the nozzle face 52) is established by its controlled and firmly secured disposition in the housing 3 held in place by the back plate 51. In one embodiment of the invention, by way of example, the diffuser clearance dimension d is 2.875±0.30 mm, while the vane height is 2.800±0.012 mm. Consequently, the vanes 9 effectively rotate against the nozzle face 52. The careful fashioning and placement of the nozzle ring 7 in relation to the diffuser face 53 permits the diffuser clearance dimension d to be finely tuned for improved diffuser clearances generally, eliminating the use of problematic spacers altogether to improve compressor performance at possibly reduced cost. As a result, the diffuser clearance dimension d is the only dimension that must be stacked up with the vane height.

Thus the vanes 9 have a uniform height dimension, and the arithmetic difference between the vane height dimension and the diffuser clearance distance d is deemed the vane end clearance, the latter being determined solely from the vane height dimension and the diffuser clearance distance.

The inventive apparatus therefore permits an extremely fine vane-to-compressor housing clearance, that is, the diffuser clearance, to be closely controlled. Spacers are not needed, due to the fact that only two dimensions (vane height and diffuser clearance) are the only parts of the stack-up. This enables smaller axial clearance for the vanes to enhance efficiency. The elimination of spacers in other known compressor designs necessitates additional machining of the housing nozzle (with the attendant increased cost), adversely affecting the components stack-up and resulting in increased diffuser clearance and decreased efficiency.

The actuating mechanism, including the crank control 22 and crank mechanism 40, can be provided with a control means for adjusting the position of the vanes 9 in the passage and thereby adjusting the passage area. The control can be performed based on, for example, pressures which are measured and monitored at the inlet and at the outlet of the compressor. Furthermore, the control can include the processing of other signals from the engine system, in manners known in the art.

The driving engagement of the internal arm 18 with the unison ring 6 is depicted in FIGS. 2 and 3. Referring especially to FIG. 3, it is seen that that internal arm 18 engages with the unison ring 6 in a manner substantially similar to the engagement of the vane arms 8 with the unison ring 6, that is, by means of a pivotal knob-and-socket type joint. Rotation of the internal arm 18 about the axis defined by the internal crank pin 17 causes the knob on the distal end of the internal arm to rotate within a corresponding socket 43 in the unison ring 6. Due to the engagement of the internal arm 18 with the unison ring 6, the pivotal movement of the internal arm 18 imparts rotational movement of the unison ring about its axis. The arc of the internal arm's pivotal movement is limited by the present of a fixed-position elastic pin 10. Rotation of the unison ring 6 thus is limited by the contact of the internal arm 18 with the elastic pin 10.

According to the invention, therefore, the crank control 22 is actuated in response to signals from pressure monitors in the compressor inlet and outlet. The crank control revolves in response to the control signals, thereby translating the crank arm 21 via the connection maintained by the retaining ring 23. The shifting movement of the crank arm 21 induces pivotal movement in the crank linkage 15 (the crank linkage 15 being pivotally connected to the crank arm 21 by the external crank pin 16), which in turn imparts rotary motion to the internal crank pin 17. Because the internal crank pin 17 is fixedly attached to the internal arm 18, so that the internal arm 18 rotates together with the internal crank pin, the rotation of the internal crank pin causes the internal arm 18 to pivot (about an axis defined by the internal crank pin 17). The pivotal movement of the internal arm 18, which swings its distal end through a defined arc, causes the unison ring 6 to rotate about its axis due to the engagement of the distal knob of the internal arm within a socket 43 in the unison ring (FIG. 3), as described previously. Referring to FIGS. 2 and 3, particularly FIG. 2, rotation of the unison ring 6 causes all the vane arms 8 to pivot, simultaneously and through the same angle, as a result of the array of uniform knob-and-socket connections of the vane arms 8 with the unison ring 6 (FIG. 3). Because the unison ring 6 is substantially rigid, all the vane arms 8 pivot uniformly in direct proportion to the pivoting of the internal arm 18.

Turbochargers for use in vehicles are subject to load states which differ depending on the operational state of the engine. In a state of a low rotational speed of the engine, the flow rate of inlet air is low. Furthermore, the requirement of the pressure at the inlet of the engine depends on the required power output from the engine. In such circumstances, the vanes 9 are adjusted to a position which decreases the passage area (i.e. the cross-sectional area of flow of the compressor nozzle).

Conversely, in a state of high rotational speed of the engine, the mass flow of inlet air also increases. In this condition, the vanes 9 are adjusted to a position which increases the passage area of the compressor nozzle.

By adjusting the positions of the vanes 9 continuously in view of the engine load state and the engine rotational speed, undesirable compressor surge can be avoided (or at least delayed). An added advantage is that the compressor choke flow also is increased. Stated differently, the vane assembly (including the plurality of vanes 9 as driven by the rotatable unison ring 6) is closed by rotating the unison ring 6 to pivot simultaneously all the vanes 9 so as to incline with respect to the tangential direction of the annular arrangement, and is opened by rotating the vanes 9 towards the opposite direction. In a low-load and low-rotational speed range of the engine, the vane assembly is closed. The vane assembly is rotated towards the opened direction in a high-load and high-rotational speed range of the engine. Consequently, the operating range of the compressor is increased.

In sum, therefore, the flow passage area in the diffuser is adjustable by adjusting the pivotal position of at least one, preferably all, the diffuser vanes 9, and preferably pivoting all the vanes a uniform amount or degree. The plurality of vanes 9 is disposed in a circular array about an imaginary central axis, with the annular unison ring 6 rotatable about that same imaginary array axis. Each vane arm 8 of the plurality of vane arms is pivotally connected to a corresponding diffuser vane 9 and also pivotally connected to the unison ring 6; accordingly, the crank mechanism 20 controllably rotates the unison ring 6, so that controlled rotation of the unison ring simultaneously pivots the vanes in the diffuser space. The crank mechanism includes the rotatable internal arm 18 pivotally connected to the unison ring 6, so that rotation of the internal arm imparts rotary motion in the unison ring.

The operation of the compressor wheel 4 of course generates pressure differences along the gas flow path from the inflow volute 31 to the diffuser exit at the outflow volute 47. Undesirable gas leaks are possible between the vane suction and pressure sides, and from the diffuser space, along the vane arms 8, to behind the nozzle ring 7, and also and most significantly along and behind the nozzle ring 7, from the diffuser exit in outflow volute 47 back toward the diffuser inlet (in inflow section 31) upstream of the vanes 9. Such parasitic losses at the diffuser inlet are detrimental to performance because they modify the air incidence in the variable geometry vanes 9.

Reference is made to FIGS. 4-6. A significant improvement of the invention is the provision of a sealing means, such as resilient o-rings 12, 13 disposed between the center housing 2 and the nozzle ring 7, and between the compressor housing back plate 51 and the annular nozzle ring 7, respectively. The sealing means thus is a sort of gasket, whether an integral ring (such as an o-ring) or composed of separable adjacent pieces. The O-rings serve to seal against the flow of gas the very narrow gaps between the center housing 2 and the nozzle ring 7, and between the compressor housing back plate 51 and the annular nozzle ring 7. These o-rings may be made from any suitable durably elastic material, including but not limited to Neoflon®, or Viton®polymers. O-rings serve to prevent two potentially deleterious leakages within or from the compressor apparatus. It is expressly understood that other seals besides O-rings may be useable in the invention to prevent the deleterious leakages, O-rings being merely the currently preferred mode for practicing the invention.

Helpful reference is made particularly to FIGS. 4 and 6. First, the pressure gradients generated by the operation of the compressor tend to induce gas flow in the form of leakage between the nozzle ring 7 and the compressor housing back plate 51. More specifically, the pressure differentials created during compressor impeller operation tend to induce a leakage flow from the interstitial spaces surrounding the internal arm 18, between the inner end 49 of the nozzle ring 7, and into the inflow section 31 between the outer and inner walls, 32, 34 of the housing 3. Similarly, pressure differences may cause gas leakage from the outflow section 47 (downstream from the vanes 9), between the outer end 50 of the nozzle ring 7 and into the spaces around the internal arm 18 and the unison ring 6. Both these leakages can significantly and adversely impact the overall efficiency of the apparatus. Also, in the absence of sealing o-rings 12, 13, gas also may leak from the spaces between the nozzle ring 7 and the internal arm 18, past the internal crank pin 17 (e.g. between the pin 17 and bushing 19), to the exterior of the apparatus and to the ambient air. This type of leakage may result in the discharge of oily vapors and other undesirable gases into the ambient air.

The foregoing leakages are ameliorated or prevented altogether by the o-rings 12, 13. The inner o-ring 12 prevents leakage between the inner end 49 of the nozzle ring 7 and the center housing 2. The outer o-ring 13 prevents leakage between the outer end 50 of the nozzle ring 7 and the back plate 51. Suitable grooves or ledges may be machined in the nozzle ring 7, the housing 3, and/or the back plate 51 as seats for receiving and holding the O-rings 12, 13.

Thus, the back plate 51 helps hold the nozzle ring 7 against the housing 3 while there is provided a seal means for preventing gas leakage from the vicinity of the diffuser space past the nozzle ring 7. The means for sealing may be one or more resilient inner o-rings 12 disposed between the center housing and the inner end of the nozzle ring, and/or one or more resilient outer O-rings 13 disposed between the compressor housing back plate 51 and the outer end of the nozzle ring.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A variable geometry compressor comprising:

a compressor housing, said housing having an annular diffuser surface therein;

a nozzle ring seated on said housing, said nozzle ring defining an annular nozzle face in spaced-apart relation to said diffuser face;

a diffuser space defined between said nozzle face and said diffuser surface; and at least one pivotal diffuser vane in said diffuser space and pivotal against said nozzle face, wherein said nozzle face and said diffuser surface are spaced-apart by a diffuser clearance distance, and wherein said diffuser clearance distance is adjustable by modifying the position of said nozzle ring in relation to said diffuser surface.

2. An apparatus according to claim 1 wherein said vanes have a uniform height dimension, and the difference between said vane height dimension and said diffuser clearance distance comprises a vane end clearance, and wherein further said vane end clearance is determined solely from said vane height dimension and said diffuser clearance.

3. An apparatus according to claim 1 wherein a flow passage area in said diffuser is adjustable by adjusting the pivotal position of said at least one diffuser vane.

4. An apparatus according to claim 3 wherein said at least one diffuser vane comprises a plurality of vanes disposed in a circular array about an axis, and further comprising:

an annular unison ring rotatable about said array axis;

a plurality of vane arms, each said vane arm pivotally connected to a diffuser vane and pivotally connected to said unison ring; and a crank mechanism for controllably rotating said unison ring;

wherein controlled rotation of said unison ring simultaneously pivots said vanes in said diffuser space.

5. An apparatus according to claim 4 wherein said crank mechanism comprises a rotatable internal arm pivotally connected to said unison ring, whereby rotation of said internal arm imparts rotary motion in said unison ring.

6. An apparatus according to claim 1 further comprising:

a back plate for holding said nozzle ring against said housing; and sealing means for preventing gas leakage from the vicinity of said diffuser space past said nozzle ring.

7. An apparatus according to claim 6 wherein said means for preventing comprises at least one resilient inner o-ring disposed between said back plate and an inner end of said nozzle ring.

8. An apparatus according to claim 6 wherein said means for preventing comprises at least one resilient outer o-ring disposed between said compressor housing and an outer end of said nozzle ring.

9. A variable geometry compressor comprising:

a compressor housing, said housing having an annular diffuser surface therein;

a nozzle ring seated on said housing, said nozzle ring defining an annular nozzle to face in spaced-apart relation to said diffuser face;

a diffuser space defined between said nozzle face and said diffuser surface; and at least one pivotal diffuser vane in said diffuser space and pivotal against said nozzle face;

wherein said nozzle face and said diffuser surface are substantially parallel and spaced-apart by a diffuser clearance distance;

wherein said diffuser clearance distance is adjustable by modifying the position of said nozzle ring in relation to said diffuser surface.

10. An apparatus according to claim 9 wherein said vane end clearance is less than approximately 5% of said diffuser clearance distance.

11. An apparatus according to claim 10 wherein said vanes have a uniform height dimension, and a difference between said vane height dimension and said diffuser clearance distance comprises a vane end clearance, and wherein further said vane end clearance is determined solely from said vane height dimension and said diffuser clearance distance.

12. An apparatus according to claim 11 wherein a flow passage area in said diffuser is adjustable by adjusting the pivotal position of said at least one diffuser vane.

13. An apparatus according to claim 12 wherein said at least one diffuser vane comprises a plurality of vanes disposed in a circular array about an axis, and further comprising:

an annular unison ring rotatable about said array axis;

a plurality of vane arms, each said vane arm pivotally connected to a diffuser vane and pivotally connected to said unison ring; and a crank mechanism for controllably rotating said unison ring;

wherein controlled rotation of said unison ring simultaneously pivots said vanes in said diffuser space.

14. An apparatus according to claim 13 wherein said crank mechanism comprises a rotatable internal arm pivotally connected to said unison ring, whereby rotation of said internal arm imparts rotary motion in said unison ring.

15. An apparatus according to claim 14 further comprising:

a back plate for holding said nozzle ring against said housing; and seal means for preventing gas leakage from the vicinity of said diffuser space past said nozzle ring.

16. An apparatus according to claim 15 wherein said means for sealing comprises at least one resilient inner o-ring disposed between said back plate and an inner end of said nozzle ring.

17. An apparatus according to claim 16 wherein said means for sealing comprises at least one resilient outer o-ring disposed between said compressor housing and an outer end of said nozzle ring.

18. A variable geometry compressor comprising:

a compressor housing having a back plate thereon, said back plate having an annular diffuser surface therein;

a nozzle ring seated on said housing, said nozzle ring defining an annular nozzle face in spaced-apart relation to said diffuser face;

a diffuser space defined between said nozzle face and said diffuser surface; and at least one pivotal diffuser vane in said diffuser space and pivotal against said nozzle face, wherein said nozzle face and said diffuser surface are substantially parallel and spaced-apart by a diffuser clearance distance and wherein said diffuser clearance distance is adjustable by modifying the position of said nozzle ring in relation to said diffuser surface.

* * * * *